United States Patent [19]

Koblick

[11] 4,057,261

[45] Nov. 8, 1977

[54] SKI POLE

[75] Inventor: Jeffrey M. Koblick, Hopkins, Minn.

[73] Assignee: K-Tel International, Inc., Minnetonka, Minn.

[21] Appl. No.: 693,354

[22] Filed: June 7, 1976

[51] Int. Cl.[2] ..... A63C 11/22

[52] U.S. Cl. ..... 280/11.37 H; 280/11.37 Z

[58] Field of Search ..... 280/11.37 H, 11.37 N, 280/11.37 Z, 11.37 B, 11.37 D, 11.37 P, 11.37 L, 11.37 F, 11.37 A

[56] References Cited

U.S. PATENT DOCUMENTS

| | | | |
|---|---|---|---|
| 2,627,420 | 2/1953 | Wheeler et al. | 280/11.37 B |
| 3,540,751 | 11/1970 | Pierce | 280/11.37 H |
| 3,582,100 | 6/1971 | Allsop | 280/11.37 B |
| 3,595,596 | 7/1971 | Bruckl | 280/11.37 Z |
| 3,825,275 | 7/1974 | Klemm | 280/11.37 N |

FOREIGN PATENT DOCUMENTS

| | | | |
|---|---|---|---|
| 842,085 | 5/1970 | Canada | 280/11.37 B |
| 861,067 | 1/1941 | France | 280/11.37 H |
| 11,785 | 4/1902 | Norway | 280/11.37 N |
| 157,702 | 10/1932 | Switzerland | 280/11.37 H |
| 527,678 | 10/1940 | United Kingdom | 280/11.37 N |

*Primary Examiner*—Joseph F. Peters, Jr.
*Assistant Examiner*—David M. Mitchell
*Attorney, Agent, or Firm*—Allegretti, Newitt, Witcoff & McAndrews

[57] ABSTRACT

An improved toy ski pole is disclosed. The improvement includes a grip assembly permitting replacement of the restraining strap, if torn or damaged, and basket assembly for securing a pair of ski poles together. The grip assembly locks the restraining strap to the hand grip and ski pole.

4 Claims, 5 Drawing Figures

SKI POLE

BACKGROUND OF THE INVENTION

The present invention relates generally to an improved ski pole and more particularly to an improved grip assembly and basket for a toy ski pole.

A ski pole includes a grip assembly or, more particularly, a hand grip and retaining strap. The grip and strap are usually a single-piece construction such that damage to the strap requires replacement of the entire grip assembly.

Ski poles are also cumbersome and inconvenient to transport and store. The most convenient way to carry ski poles is to place the retaining straps over one wrist, thereby freeing the other hand to carry other equipment, such as skis. However, in this mode, the basket end of the poles swings independently and freely, often endangering the carrier.

SUMMARY OF THE INVENTION

In a principal aspect, the present invention is an improved ski pole. One embodiment of the present invention is an improved grip assembly. The improved grip assembly permits replacement of the retaining or restraining strap alone, should damage thereto occur.

The improvement includes a hand grip, defining a side and end opening, and a retaining strap having a first and second securing knob on the ends thereof. The hand grip is adapted to receive the hollow shaft of a ski pole in an assembled state.

In the assembled state, the side opening of the grip receives the ends of the retaining strap. The first and second securing knobs are urged into the end opening and hollow shaft, respectively, to secure the restraining strap to the hand grip.

Another embodiment of the present invention is an improved basket assembly for a ski pole. The improvement includes a tip portion adapted to receive the shaft of the ski pole and a disc portion extending therefrom. The disc portion is flexible and defines a coupling slot. In cooperation, the flexibility and coupling slot of the disc portion define means for securing the ski pole to another ski pole, thereby facilitating transportation and storage.

It is thus an object of the present invention to provide an improved ski pole.

It is a further object of the present invention to provide an improved grip assembly for a ski pole, permitting replacement of the retaining strap alone.

It is also an object of the present invention to provide a readily manufactured grip assembly for a ski pole.

It is another object of the present invention to provide an improved basket assembly for a ski pole.

It is still another object of the present invention to provide an improved basket assembly whereby a pair of ski poles can be securely coupled together.

These and other objects, features and advantages of the present invention are apparent in the following detailed description.

BRIEF DESCRIPTION OF THE DRAWINGS

A preferred embodiment of the present invention will be described, in detail, with respect to the drawing wherein.

DESCRIPTION OF THE PREFERRED EMBODIMENT

Figure 1:
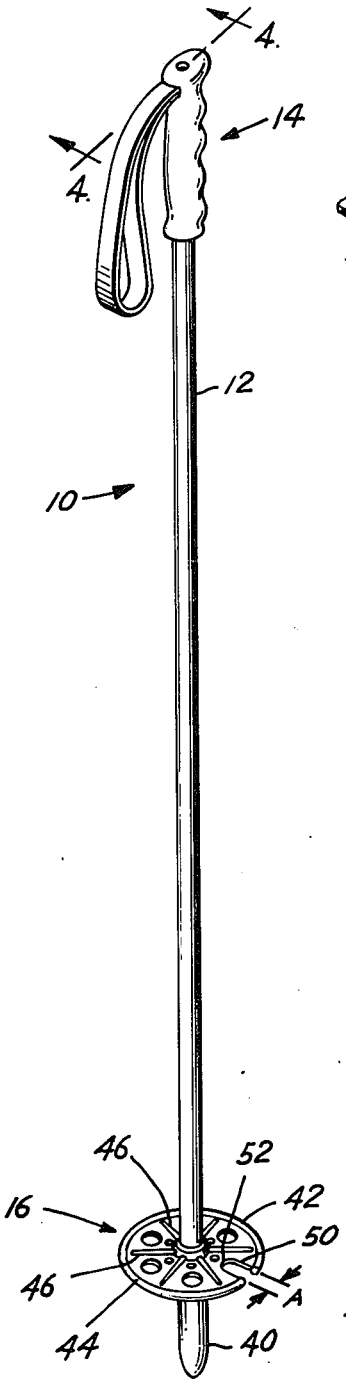
FIG. 1 is a plan view of a ski pole including preferred embodiments of the present invention.

Referring to FIG. 1, an improved ski pole 10 is shown. The ski pole 10 includes a substantially cylindrical, hollow shaft 12, improved grip assembly 14 and improved basket assembly 16.

Figure 2:
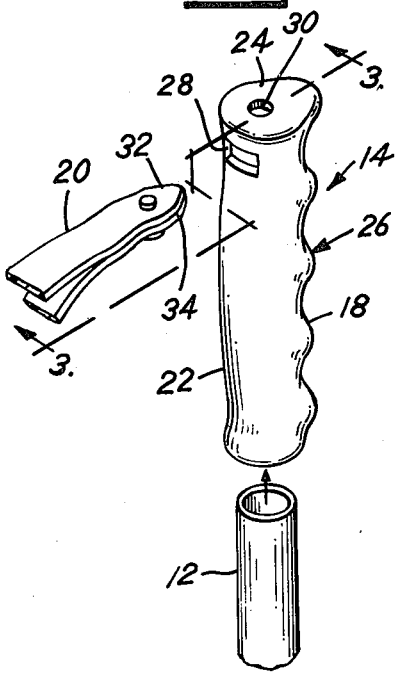
FIG. 2 is an exploded view of the improved grip assembly shown in FIG. 1.
Figure 4:
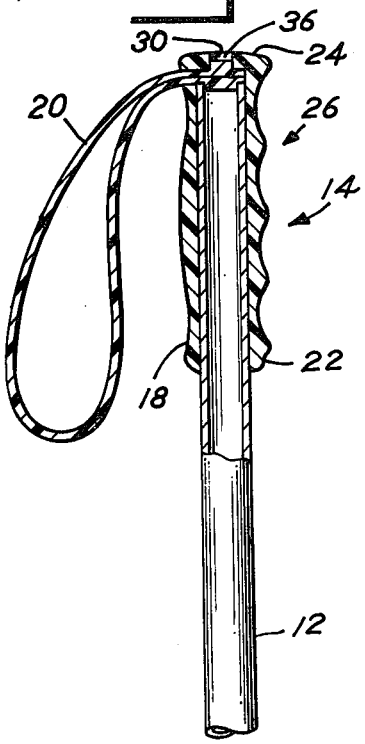
FIG. 4 is a cross sectional view of the ski pole shown in FIG. 1 taken along 4 — 4.
Figure 3:
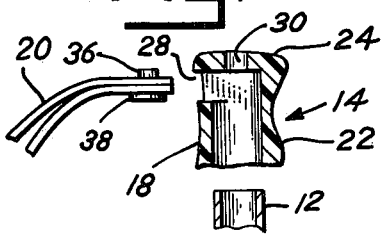
FIG. 3 is a partial cross-sectional view of the grip assembly shown in FIG. 2 taken along 3 — 3.

As best shown in FIGS. 2–4, the grip assembly 14 includes a hand grip 18 and retaining strap 20. Preferably plastic, the hand grip 18 has a side portion 22 and end portion 24. The side portion 22 is contoured to define a finger pattern, generally designated 26.

The side portion 22 is adapted to receive the hollow shaft 12 in an assembled state. Opposite the finger pattern 26 and substantially adjacent the end portion 24, the side portion 22 defines a side opening 28 adapted to receive the retaining strap 20.

The end portion 24 of the hand grip 18 defines an end opening 30. In the assembled state, the end opening 30 and longitudinal axis of the shaft 12 substantially align.

The retaining strap 20 is preferably a strip of plastic material, having a first end 32 and a second end 34. The first and second ends 32, 34 respectively define a first and second securing knob 36, 38. As shown, the securing knobs 36, 38 are preferably substantially cylindrical. The diameters of the end opening 30 and the first securing knob 36 are substantially equal, as are the diameters of the shaft 12 and second securing knob 38.

In the assembled state, the retaining strap 20 is folded such that the first and second ends 32, 34 are substantially adjacent and the first and second securing knobs 36, 38 extend in opposite directions therefrom. The ends 32, 34 are received by the side opening 28. That is, the side opening 28 is sufficient to pass the composite thickness of the first and second ends 32, 34 and securing knobs 36, 38, as best shown in FIG. 3.

Referring now to FIG. 4, the end opening 30 of the hand grip 18 and the hollow shaft 12 respectively receive the first and second securing knobs 36, 38 to substantially secure the retaining strap 20 to the ski pole 10. The hollow shaft 12 contacts the second end 34 of the retaining strap 20 in the assembled state and causes the engagement described above. That is, movement of the shaft 12 towards the end 34 urges the first and second securing knobs 36, 38 into the end opening 30 and shaft 12, respectively.

To remove and/or replace the retaining strap 20, the hand grip 18 is displaced longitudinally with respect to the shaft 12 to free the securing knobs 36, 38. The retaining strap 20 is then withdrawn through the side opening 28. The ends 32, 34 of the retaining strap 20 are tapered to facilitate insertion and withdrawal, as shown in FIG. 2.

Figure 5:
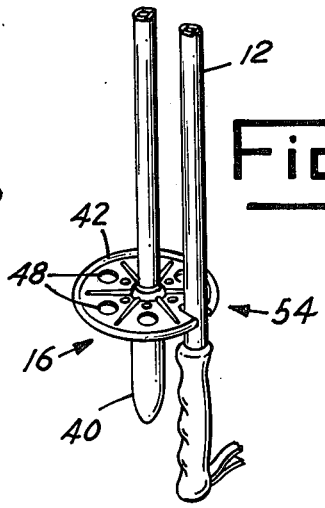
FIG. 5 is a plan view of the improved basket assembly shown in FIG. 1, illustrating the coupling of two ski poles.
Figure 5:
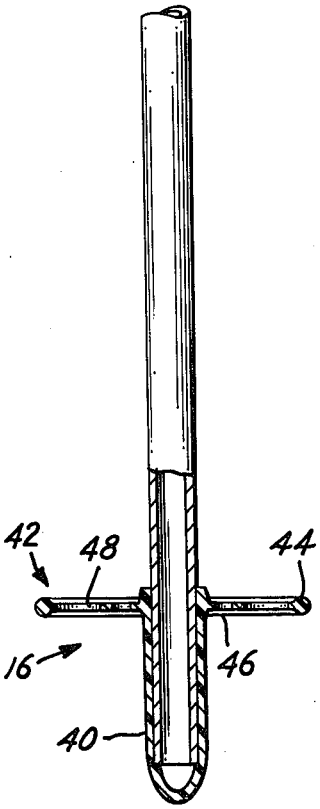

Referring to FIGS. 1, 4 and 5, the improved basket assembly 16 includes a tip portion 40 and a disc portion 42. Preferably plastic and integral with the disc portion 42, the tip portion 40 is adapted to receive the hollow shaft 12.

The disc portion 42 extends outwardly from the tip portion 40, substantially perpendicular thereto. The substantially circular disc portion 42 includes an outer perimetric ridge 44 and radially-extending reinforcement ribs 46. A series of openings 48 interposes the reinforcing ribs 46.

The disc portion 42 also includes a coupling slot 50, extending from the perimetric ridge 44 towards the tip portion 40 of the basket assembly 16. The coupling slot 50 has an open dimension, designated "A" in FIG. 1, and an arcuate end 52. In this preferred embodiment of the present invention, the open dimension "A" and outer, cross sectional dimension or diameter of the hollow shaft 12 are substantially equal, such that the coupling slot 50 is adapted to receive the shaft 12 of a second ski pole 10, as shown in FIG. 5.

The disc portion 42 is a flexible material, such as plastic. The flexibility and coupling slot 50 of the disc portion 42 cooperatively define means, generally designated 54, for securing a pair of ski poles 10 together. That is, the improved basket assembly 16 of each ski pole 10 receives the shaft 12 of the other, thereby coupling the poles 10 together as a unit. This coupling substantially facilitates transportation and storage of the ski pole 10.

More particularly, the coupling slot 50 engagingly receives the shaft 12, such that the disc portion 42 is flexed. This flection causes the disc portion 42 to "pinch" the shaft 12, providing positional maintenance.

Two embodiments of the present invention have been disclosed and described herein. It is to be understood, however, that various modifications and changes can be made without departing from the true scope and spirit of the present invention, as defined by the following claims.

What is claimed is:

1. An improved hand grip and retaining strap assembly for a ski pole which includes a ski pole shaft having a generally cylindrical first end and a recess in the first end thereof, the improved hand grip and retaining strap assembly comprising:

a hand grip which includes a generally cylindrical, elongated side wall portion, having a first end and a second end, and which has a end wall portion that substantially closes the first end of the side wall portion and that has a recess therein facing the second end of the side wall portion, the end wall portion and the side wall portion defining a generally cylindrical, elongated recess within the hand grip, with the elongated recess being open at the second end of the side wall portion and being adapted to receive the first end of the ski pole shaft therein so that the first end of the ski pole shaft may be frictionally retained within the elongated recess and be positioned adjacent to the end wall portion and so that the longitudinal axes of the first end of the ski pole shaft and the elongated recess are coaxial;

a retaining strap having a first end and a second end;

a first securing knob secured on the first end of the retaining strap and being adapted to be pressed within and engaged by the recess in the first end of the ski pole shaft;

a second securing knob secured on the second end of the retaining strap and being adapted to be pressed within the engaged by the recess in the end wall portion of the hand grip; and the side wall portion of the hand grip having a side opening therein substantially adjacent to the first end of the side wall portion, with the side opening being of such a size and shape that the composite thickness of the first and second ends of the retaining strap, including the first and second securing knobs, may be passed therethrough, from the exterior of the hand grip into the interior of the elongated recess, the improved hand grip and retaining strap when assembled being characterized by the first and second ends of the retaining strap being disposed within the elongated recess, with the retaining strap extending through the side opening with said first and second end in contact with each other, and by the first end of the ski pole shaft being disposed within the elongated recess in the hand grip so that the first end of the ski pole shaft is positioned adjacent to the end wall portion of the hand grip and in contact with said first and, with the first securing knob facing the first end of the ski pole shaft and being within and engaged by the recess in the first end of the ski pole shaft and with the second securing knob facing the end wall portion of the hand grip and being within and engaged by the recess in the end wall portion, said second end contacting said end wall the engagement between the first securing knob and the recess in the first end of the ski pole shaft and the engagement between the second securing knob and the recess in the end wall portion constituting the sole means of retaining the first and second ends of the retaining strap within the hand grip.

2. The improved hand grip and retaining strap assembly described in claim 1 wherein the first and second securing knobs are integrally formed on the first and second ends of the retaining strap, respectively; and wherein the longitudinal central axes of the recesses formed in the end wall portion of the hand grip and in the first end of the ski pole shaft are coaxial when the ski pole shaft is disposed within the elongated recess.

3. The improved hand grip and retaining strap assembly described in claim 1 wherein the recess in the end wall portion of the hand grip extends through the end wall portion; and wherein the side wall portion of the hand grip includes a finger pattern formed in portion thereof substantially diametrically opposite from the side opening formed in the side wall portion.

4. The improved hand grip and retaining strap assembly described in claim 1 wherein the side wall portion and the end wall portion are integrally formed from a plastic material; wherein the first and second securing knobs are cylindrical; and wherein the recess in the end wall portion of the hand grip and the recess in the one end of the ski pole shaft are cylindrical.

* * * * *